US006595514B2

(12) United States Patent
Takahashi

(10) Patent No.: US 6,595,514 B2
(45) Date of Patent: Jul. 22, 2003

(54) SHEET FEEDING DEVICE AND IMAGE FORMING APPARATUS INCLUDING THE SHEET FEEDING DEVICE

(75) Inventor: Toshiaki Takahashi, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/982,878

(22) Filed: Oct. 22, 2001

(65) Prior Publication Data

US 2002/0063374 A1 May 30, 2002

(30) Foreign Application Priority Data

Oct. 20, 2000 (JP) ..... 2000-321576
Sep. 18, 2001 (JP) ..... 2001-284191

(51) Int. Cl.[7] ..... B65H 1/00

(52) U.S. Cl. ..... 271/162; 271/213; 400/625; 400/624; 400/626

(58) Field of Search ..... 271/162, 213; 347/104; 346/136; 400/624, 625, 626, 627, 628, 629; 16/319, 355; 248/442.2, 447, 454, 456, 414

(56) References Cited

U.S. PATENT DOCUMENTS 5,040,025 A 8/1991 Fukuchi
5,052,336 A 10/1991 Fukuchi
5,055,881 A 10/1991 Fukuchi
5,124,759 A 6/1992 Fukuchi et al.
5,300,996 A 4/1994 Yokoyama et al.
5,329,340 A 7/1994 Fukuchi et al.
5,689,764 A 11/1997 Fukuchi et al.
RE36,124 E 3/1999 Yokoyama et al.
6,128,451 A 10/2000 Fukuchi
6,181,899 B1 1/2001 Fukuchi
6,385,418 B1 5/2002 Fukuchi

FOREIGN PATENT DOCUMENTS

JP 09156817 6/1997
JP 2000318884 11/2000

*Primary Examiner*—Donald P. Walsh
*Assistant Examiner*—Kaitlin S. Joerger
(74) *Attorney, Agent, or Firm*—Oblon, Spivak, McClelland, Maier & Neustadt, P.C.

(57) ABSTRACT

A sheet feeding device for an image forming apparatus including a main body case includes a sheet feeding tray that is rotatably supported by the main body case so as to be placed at at least a closed position where a sheet feeding inlet is closed by the sheet feeding tray and an open position where the sheet feeding inlet is opened for feeding the sheet into the main body case, a sheet feeding member that feeds the sheet on the sheet feeding tray into the main body case, and an arm including a base end part and a tip end part. The tip end part of the arm includes an arm engagement part that is engaged with an engagement part for the open position provided to the main body case so as to place the sheet feeding tray at the open position.

20 Claims, 10 Drawing Sheets

SHEET FEEDING DEVICE AND IMAGE FORMING APPARATUS INCLUDING THE SHEET FEEDING DEVICE

This document claims priority and contains subject matter related to Japanese Patent Application No. 2000-321576 filed in the Japanese Patent Office on Oct. 20, 2000, and Japanese Patent Application No. 2001-284191 filed in the Japanese Patent Office on Sep. 18, 2001, and the entire contents of each of which are hereby incorporated herein by reference.

BACKGROUND OF THE INVENTION

1. Field of the Invention

The present invention relates to a sheet feeding device and an image forming apparatus including the sheet feeding device.

2. Discussion of the Background

A sheet feeding device has been used in an image forming apparatus, such as a printer, a copying machine, a facsimile machine, etc. or a multi-functional image forming apparatus including at least two functions of printing, copying, and faxing. The sheet feeding device includes a sheet feeding tray and a sheet feeding member. When the sheet feeding device is in use, the sheet feeding tray is rotated to an open position, and a sheet set on the sheet feeding tray is fed into a main body case of the image forming apparatus by the sheet feeding member through a sheet feeding inlet provided at the main body case. When the sheet feeding device is not in use, the sheet feeding tray is placed at a closed position where the sheet feeding tray is retracted. Because the sheet feeding tray is not protruding from the main body case when the sheet feeding device is not in use, the sheet feeding tray is prevented from interfering with surrounding items.

When a sheet is fed from the sheet feeding tray which is rotated to the open position, the position of the sheet feeding tray relative to the sheet feeding member may not be accurate. As a result of such an inaccuracy, the sheet can not be fed properly into the main body case.

In a background sheet feeding device described in Japanese Laid-open Patent Publication No. 9-150995, in order to place a sheet feeding tray at an open position with accuracy, the sheet feeding tray is rotatably supported by a supporting member fixed to a main body case. A stopper is provided at the sheet feeding tray to abut an engagement part of the supporting member.

SUMMARY OF THE INVENTION

According to one aspect of the present invention, a sheet feeding device for an image forming apparatus including a main body case includes a sheet feeding tray on which a sheet is set. The sheet feeding tray is rotatably supported by the main body case so as to be placed at a closed position when a sheet feeding inlet is closed. It is through the sheet feeding inlet from which sheets on the sheet feeding tray are fed into the main body case. Further, the sheet feeding tray is placed at an open position when the sheet feeding inlet is open. A sheet feeding member is configured to feed the sheet on the sheet feeding tray into the main body case. An arm is fixed to the sheet feeding tray. The arm includes a base end part and a tip end part. The base end part of the arm is fixed to the sheet feeding tray at a predetermined distance apart from a rotation center part of the sheet feeding tray toward a free end side of the sheet feeding tray. The tip end part is housed in the main body case. The tip end part of the arm includes an arm engagement part configured to be engaged with an engagement part for the open position provided to the main body case so that the sheet feeding tray is placed at the open position.

According to another aspect of the present invention, a method of operating a sheet feeding device for an image forming apparatus including a main body case. The method includes: rotating a sheet feeding tray to an open position when a sheet feeding inlet through which a sheet is fed into the main body case is opened; placing the sheet feeding tray at the open position by engaging an arm engagement part of a tip end part of an arm fixed to the sheet feeding tray and an engagement part for the open position provided to the main body case; setting a sheet on the sheet feeding tray; feeding the sheet on the sheet feeding tray into the main body case; rotating the sheet feeding tray to a closed position where the sheet feeding inlet is closed by the sheet feeding tray; and placing the sheet feeding tray at the closed position by engaging the arm engagement part and an engagement part for the closed position provided to the main body case.

Objects, features, and advantages of the present invention will become apparent from the following detailed description when read in conjunction with the accompanying drawings.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
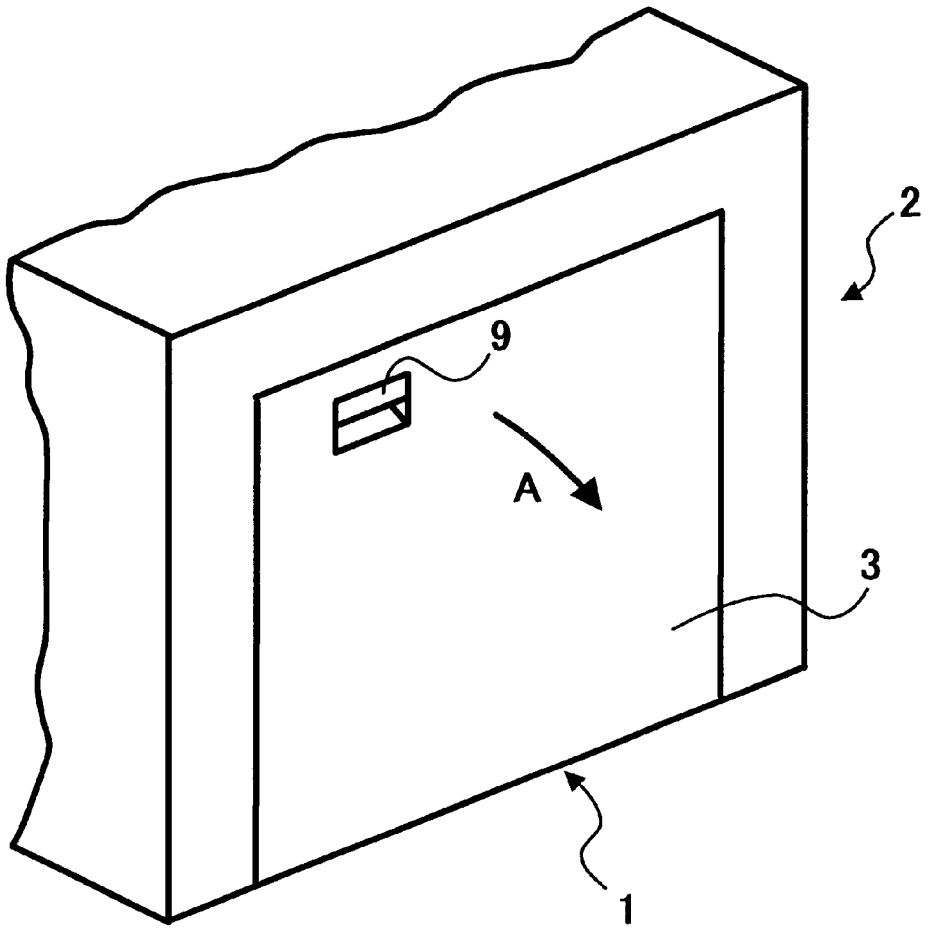
FIG. 1 is a schematic external perspective view of a part of an image forming apparatus with a sheet feeding device when a sheet feeding tray is closed.

Preferred embodiments of the present invention are described in detail referring to the drawings, wherein like reference numerals designate identical or corresponding parts throughout the several views.

Figure 2:
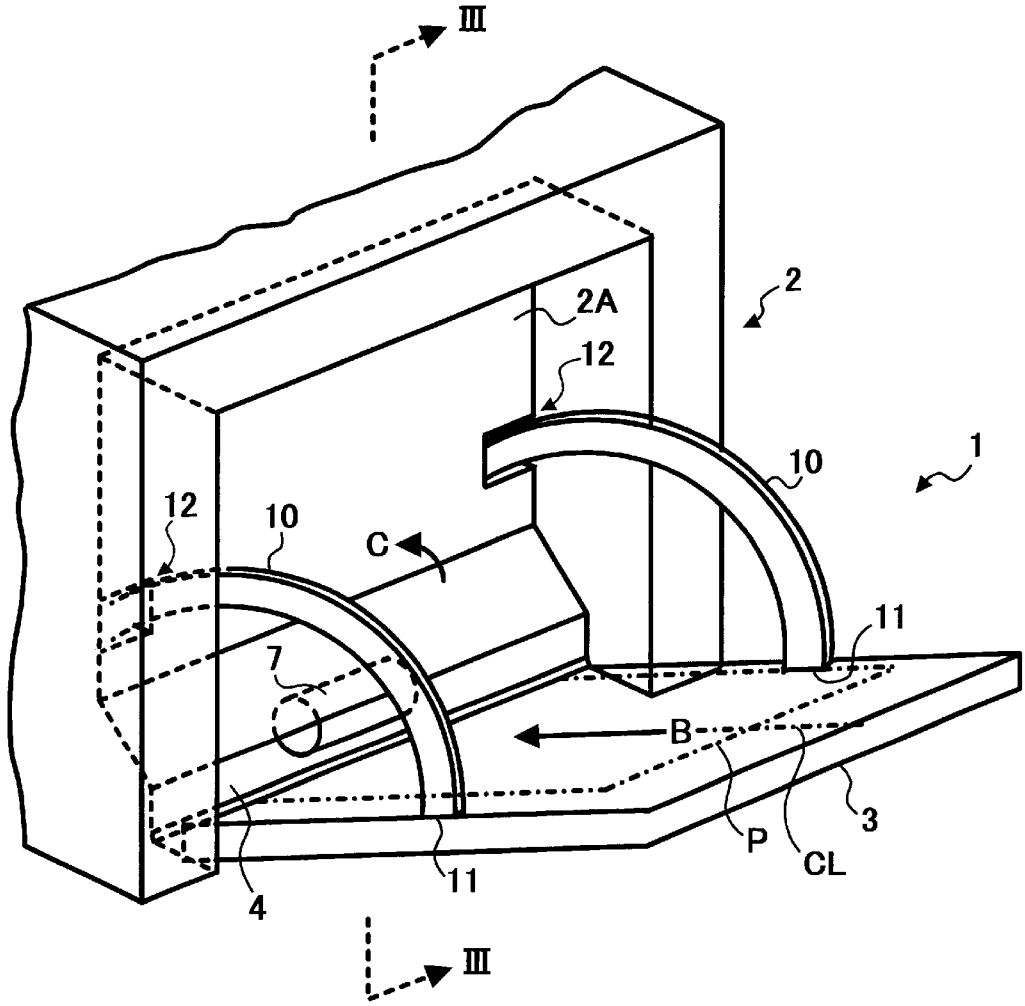
FIG. 2 is a schematic external perspective view of the image forming apparatus with the sheet feeding device of FIG. 1 when the sheet feeding tray is opened.
Figure 3:
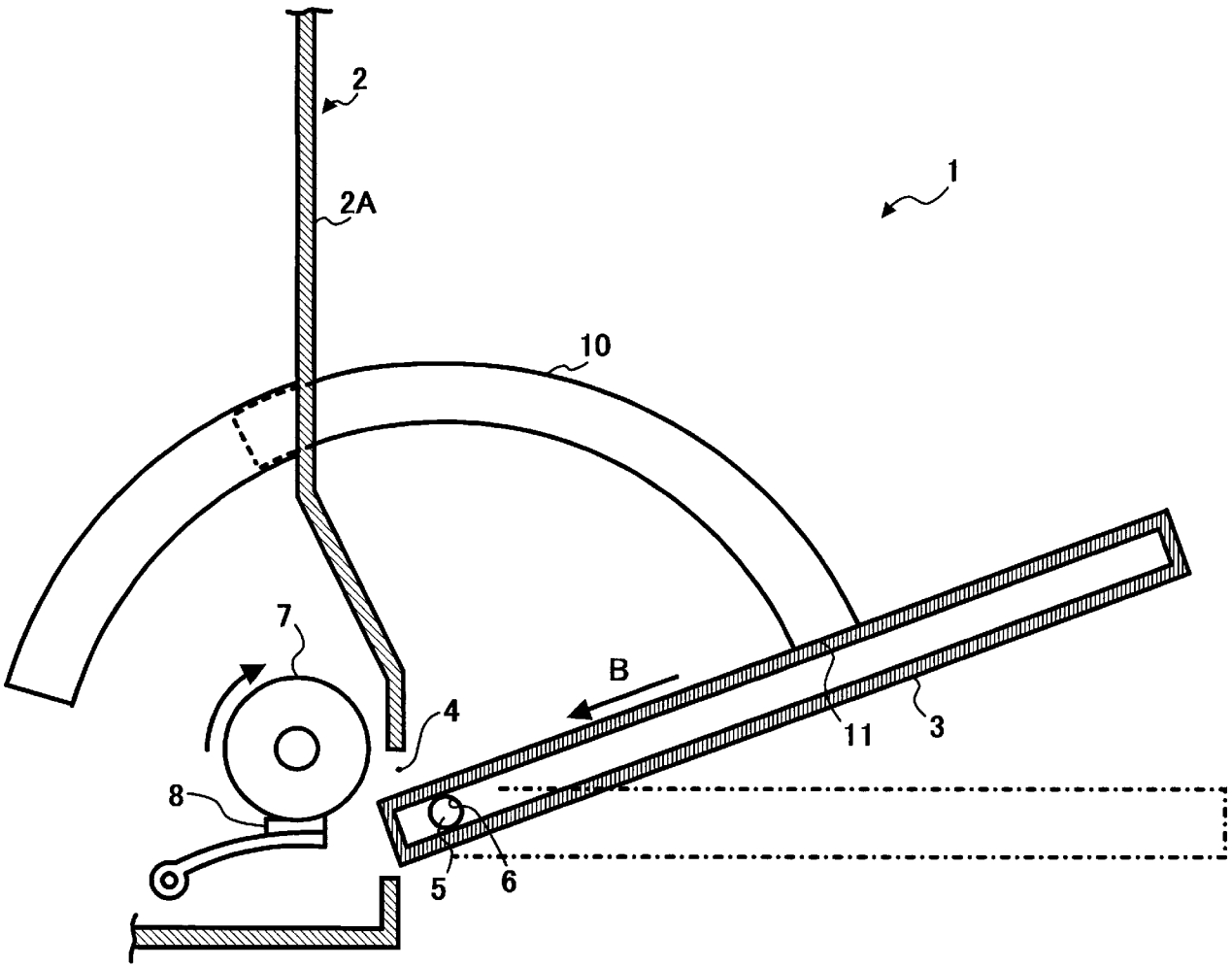
FIG. 3 is a cross sectional view taken on line III—III of FIG. 2.
Figure 4:
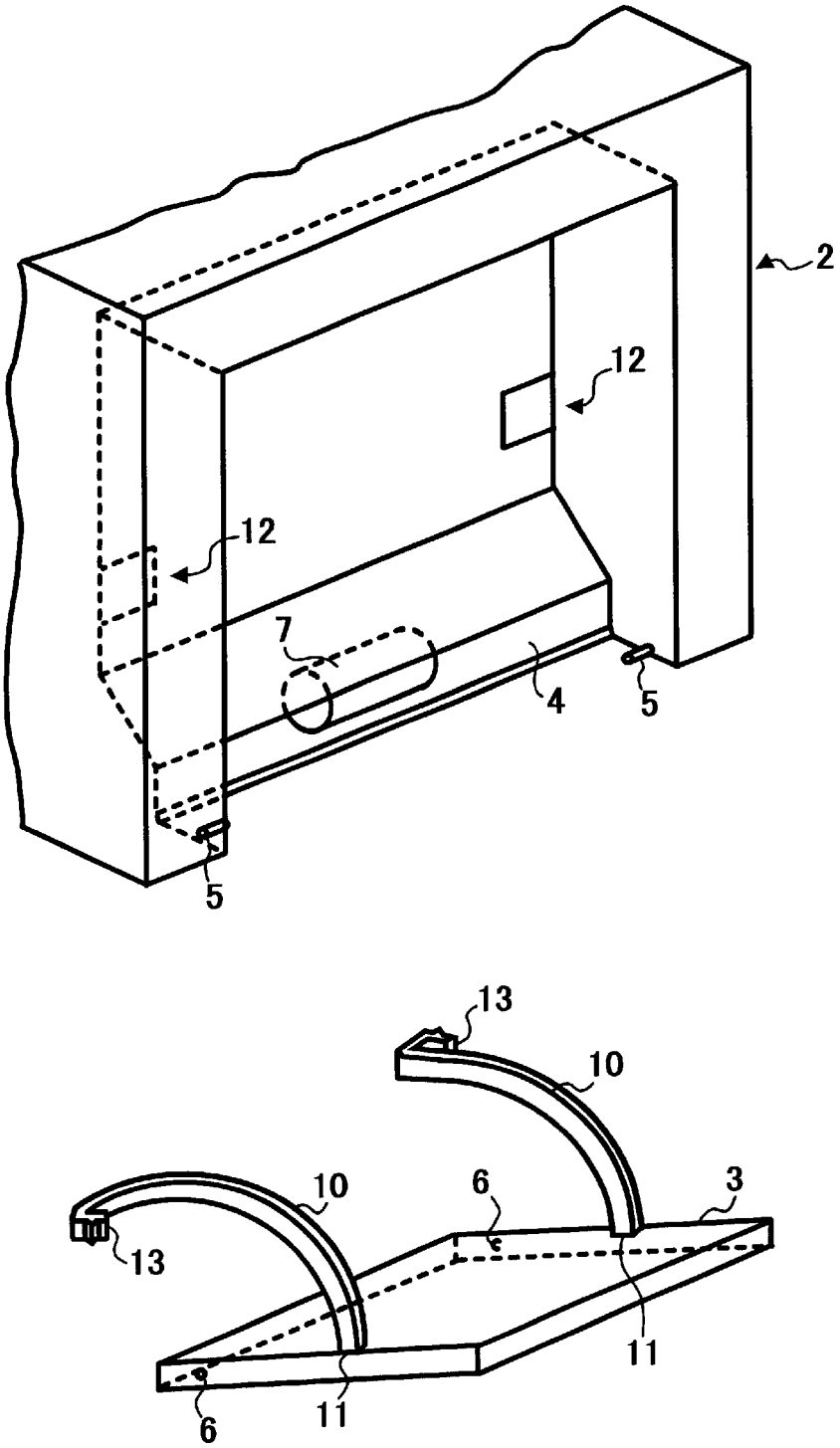
FIG. 4 is a schematic perspective view of the image forming apparatus with the sheet feeding device of FIG. 1 in which the sheet feeding tray is detached from a main body case of the image forming apparatus.

FIGS. 1 and 2 are schematic external perspective views of a part of an image forming apparatus including a sheet feeding device 1. FIG. 3 is a cross sectional view taken on line III—III of FIG. 2. The sheet feeding device 1 includes a sheet feeding tray 3 arranged at a side of a main body case 2 of an image forming apparatus. A sheet feeding inlet 4 is formed in the main body case 2 so as to guide a sheet into the main body case 2. In this embodiment, as illustrated in FIG. 2, the sheet feeding inlet 4 is situated at a lower part of a side wall 2A of the main body case 2. Further, as illustrated in FIG. 4, a pair of concentric hinge pins 5 are provided in a protruding condition at the main body case 2 in the vicinity of the sheet feeding inlet 4. A pair of hinge holes 6 formed at each widthwise side part of the sheet feeding tray 3 are rotatably engaged with the hinge pins 5, respectively. With engagements of the hinge pins 5 and the hinge holes 6, the sheet feeding tray 3 is rotatably supported by the main body case 2 between a closed position where the sheet feeding tray 3 closes the sheet feeding inlet 4 as illustrated in FIG. 1 and an open position where a sheet is fed from the sheet feeding tray 3 as illustrated in FIGS. 2 and 3.

As illustrated in FIG. 3, a sheet feeding roller 7 as an example of a sheet feeding member is arranged at a part in the main body case 2 in the vicinity of the sheet feeding inlet 4 and is rotatably supported relative to the main body case 2. A friction pad 8 as an example of a sheet separating member abuts a circumferential surface of the sheet feeding roller 7.

When the sheet feeding device 1 is not in use, the sheet feeding tray 3 is placed at the closed position as illustrated in FIG. 1 (details of which will be described later). Because the sheet feeding tray 3 is placed at the closed position when the sheet feeding device 1 is not in use, the sheet feeding tray 3 is not protruding from the main body case 2, so that the sheet feeding tray 3 does not interfere with surrounding items.

When the sheet feeding device 1 is used, an operator holds a handle 9 provided to the sheet feeding tray 3, and draws the sheet feeding tray 3 in a direction indicated by an arrow A in FIG. 1, and rotates the sheet feeding tray 3 from the closed position to the open position illustrated in FIGS. 2 and 3. When the sheet feeding tray 3 is located at the open position, the sheet feeding tray 3 is also placed at the open position as described later.

Subsequently, a single sheet P or plural sheets P are set on the sheet feeding tray 3 as illustrated by a one-dot-and-dash line in FIG. 2. When an operator presses a print key (not shown), the sheet feeding roller 7 moves down and abuts an upper surface of the sheet P, and is rotated in an arrow direction in FIG. 3. Thereby, a top sheet P is fed in a direction indicated by an arrow B in FIGS. 2 and 3 while being guided by the sheet feeding tray 3. When plural sheets P abut on the friction pad 8, the sheets P other than the top sheet P are caused to stop proceeding due to friction caused by the friction pad 8. As a non-limiting example, a pair of side fences (not shown) movable in a width direction of the sheet feeding tray 3 may be provided to the sheet feeding tray 3. In this case, widthwise side edges of the sheet P can be guided by the side fences.

The sheet P thus fed into the main body case 2 through the sheet feeding inlet 4 is conveyed to an image forming section (not shown) in the main body case 2 where a predetermined image is formed on the sheet P. Subsequently, the sheet P is discharged to a sheet discharging section (not shown) of the image forming apparatus.

When the sheet feeding device 1 is finished using, the sheet feeding tray 3 is rotated in a direction indicated by an arrow C in FIG. 2 to the closed position illustrated in FIG. 1, thereby retracting the sheet feeding tray 3.

Other than the above-described open and closed positions of the sheet feeding tray 3, it can be constructed that the sheet feeding tray 3 is placed at another open position indicated by a one-dot-and-dash line in FIG. 3, for example.

The image forming apparatus according to the embodiment of the present invention includes another sheet feeding device (not shown) that automatically feeds the sheets P to the image forming section. A sheet which is not appropriate to be fed from the another sheet feeding device is configured to be fed from the sheet feeding device 1 illustrated in FIGS. 1 through 4. The sheet feeding device 1 is generally referred to as a manual sheet feeding device. As one non-limiting alternative, the image forming apparatus may include only the sheet feeding device 1 illustrated in FIGS. 1 through 4, and the sheet P is fed to the image forming section from the sheet feeding device 1.

Hereinafter is described a construction for placing the sheet feeding tray 3 at the above-described closed position illustrated in FIG. 1 and the open position illustrated in FIG. 2. As illustrated in FIG. 2, a pair of base end parts 11 of a pair of arms 10 are fixed on the sheet feeding tray 3 at a predetermined distance apart from a rotation center part of the sheet feeding tray 3 (i.e., a part corresponding to the hinge hole 6 illustrated in FIG. 3) toward a free end side of the sheet feeding tray 3. In this embodiment, the base end parts 11 of the arms 10 are fixed on widthwise side parts of the sheet feeding tray 3, respectively.

Figure 5:
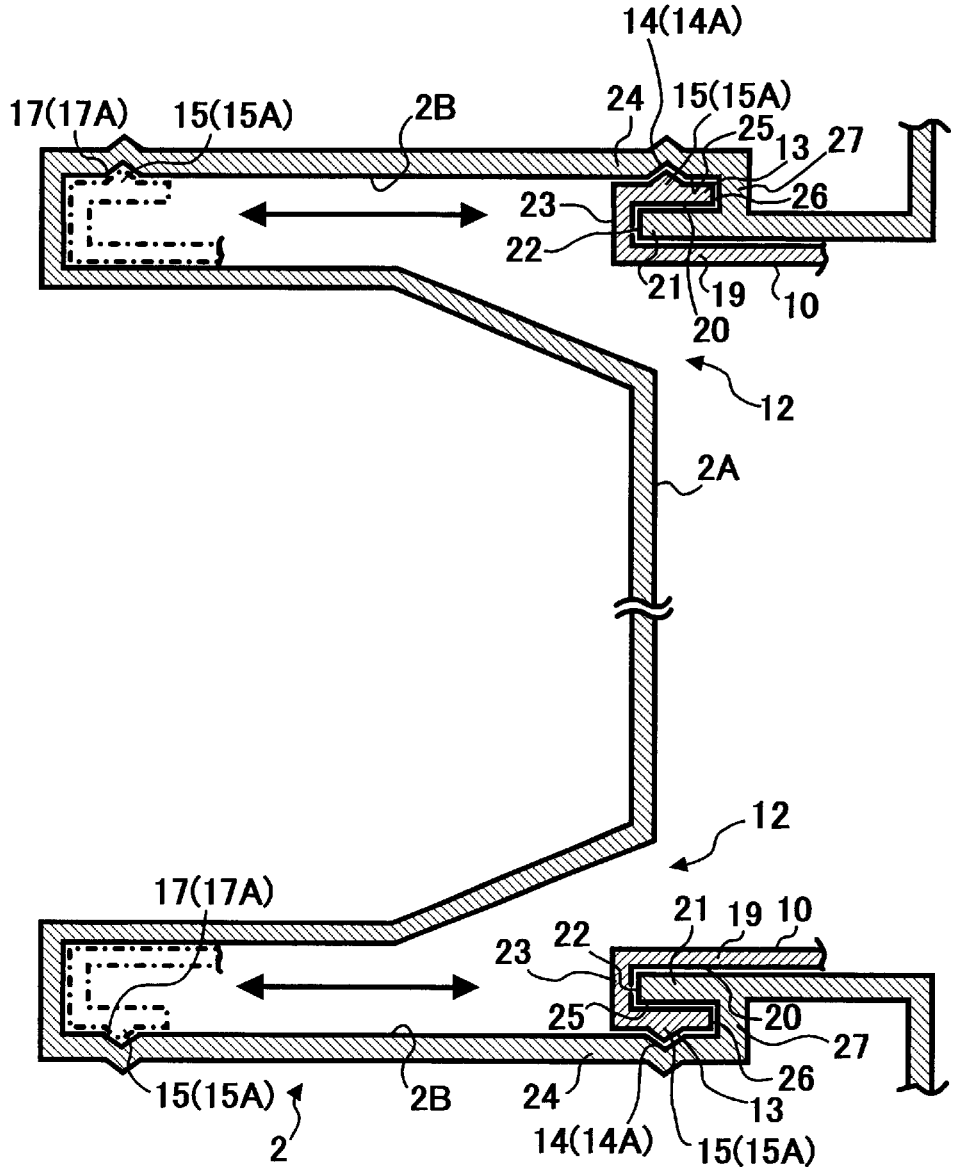
FIG. 5 is a cross sectional view of the image forming apparatus with the sheet feeding device of FIG. 1 taken substantially along a movement orbit of a tip end part of an arm and illustrates an assembly state of the arm and the main body case.
Figure 6:
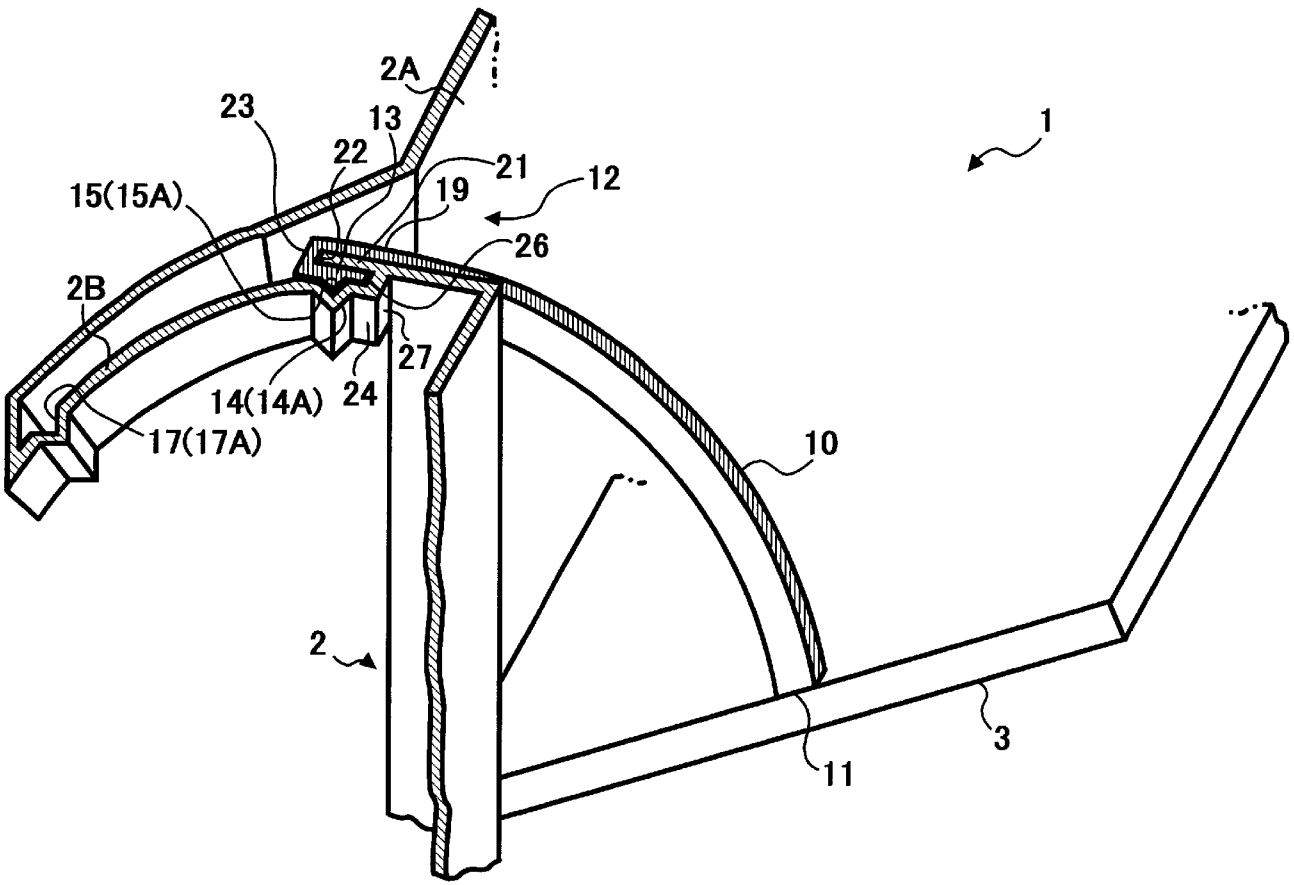
FIG. 6 is a cross sectional perspective view illustrating an assembly state of the arm and the main body case when the sheet feeding tray is located at an open position.

The paired arms 10 arcuately extend around the rotation center part of the sheet feeding tray 3 from the base end parts 11 thereof. As illustrated in FIGS. 5 and 6, the paired arms 10 respectively pass through openings 12 formed at a side wall 2A of the main body case 2, and respective tip end parts 13 of the paired arms 10 are housed in the main body case 2.

As illustrated in FIG. 5, the respective arms 10 and respective parts of the main body case 2 to which the arms 10 are assembled are formed in a symmetric state relative to a widthwise centerline CL of the sheet feeding tray 3 illustrated in FIG. 2. In this illustrative example, two arms 10 are provided on the sheet feeding tray 3. However, the number of arms 10 is not limited to two, and any other number of arms 10 is applicable.

As one non-limiting method of making the arms 10 and the sheet feeding tray 3, after the arms 10 and the sheet feeding tray 3 are formed individually, the respective base end parts 11 of the arms 10 are fixed on the sheet feeding tray 3 with a fixing member such as adhesive agent and screws. As another method, the base end parts 11 of the arms 10 can be fixed on the sheet feeding tray 3 by integrally forming the arms 10 with the sheet feeding tray 3. The sheet feeding tray 3, the arms 10, and the main body case 2 are made of material, such as, for example, hard resin, or metal, etc.

As illustrated in FIGS. 5 and 6, in order to place the sheet feeding tray 3 at the open position illustrated in FIG. 2, arm engagement parts 15 are respectively formed at the tip end parts 13 of the arms 10 so as to engage with case engagement parts 14 for the open position (hereinafter simply referred to as case engagement parts 14) provided to the main body case 2. In this embodiment, each arm engagement part 15 is formed from a convex portion 15A provided on the tip end part 13 of the arm 10 in a protruding way, and each case engagement part 14 is formed from a concave portion 14A provided at the main body case 2. By engaging the convex portions 15A and the concave portions 14A, respectively, the sheet feeding tray 3 is placed at the open position. Instead of the convex portions 1 SA and the concave portions 14A, the sheet feeding tray 3 may be placed at the open position by engaging concave portions 15A and convex portions 14A, respectively.

When rotating the sheet feeding tray 3 placed at the open position in the direction indicated by the arrow C in FIG. 2, the arm engagement parts 15 are disengaged from the case engagement parts 14, and then the convex portions 15A of the arm engagement parts 15 slide in contact with surfaces 2B of the main body case 2, respectively. When the sheet feeding tray 3 reaches the closed position illustrated in FIG. 1, the tip end parts 13 of the arms 10 are located at positions illustrated by a one-dot-and-dash line in FIG. 5, respectively. In this condition, the arm engagement parts 15 formed at the tip end parts 13 of the arms 10 are respectively engaged with case engagement parts 17 for the closed position (hereinafter simply referred to as case engagement parts 17) provided to the main body case 2, thereby placing the sheet feeding tray 3 at the closed position.

In this embodiment, similarly as the case engagement parts 14, each case engagement part 17 is formed from a concave portion 17A provided at the main body case 2. By engaging the convex portions 15A and the concave portions 17A, respectively, the sheet feeding tray 3 is placed at the closed position. Instead of the convex portions 15A and the concave portions 17A, the sheet feeding tray 3 may be placed at the closed position by engaging concave portions 15A and convex portions 17A, respectively.

When rotating the sheet feeding tray 3 placed at the closed position in the direction indicated by the arrow A in FIG. 1, the arm engagement parts 15 are disengaged from the case engagement parts 17, and then the convex portions 15A of the arm engagement parts 15 slide in contact with the surfaces 2B of the main body case 2, respectively.

When the sheet feeding tray 3 reaches the open position illustrated in FIG. 2, the arm engagement parts 15 are respectively engaged with the case engagement parts 14, thereby placing the sheet feeding tray 3 at the open position.

In the above-described sheet feeding device according to the embodiment of the present invention, because the sheet feeding tray 3 is placed at the open position by engaging the arm engagement parts 15 of the arms 10 unitarily fixed on the sheet feeding tray 3 and the case engagement parts 14 provided at the main body case 2, the sheet feeding tray 3 can be positioned relative to the main body case 2 with high accuracy.

Further, because the sheet feeding roller 7 as the sheet feeding member is supported by the main body case 2, the sheet feeding roller 7 can be positioned relative to the main body case 2 with high accuracy. Thus, because the sheet feeding tray 3 placed at the open position and the sheet feeding member are positioned relative to the main body case 2, the accuracy of position of the sheet feeding tray 3 relative to the sheet feeding member can be increased. As a result, the sheet P on the sheet feeding tray 3 can be adequately fed from the sheet feeding tray 3 to the image forming section, so that occurrence of sheet skew and trouble in conveying sheets P can be effectively prevented.

Further, because the accuracy of position of the sheet feeding tray 3 can be increased without providing members except the arms 10, a number of construction parts of the sheet feeding device can be decreased, so that the cost of the sheet feeding device can be reduced.

Moreover, in this embodiment, because the sheet feeding tray 3 is placed at the closed position by engaging the arm engagement parts 15 and the case engagement parts 17 provided at the main body case 2, respectively, the sheet feeding tray 3 can be placed at the closed position without providing members except the arms 10. As a result, the cost of the sheet feeding device 1 can be further reduced.

Moreover, in the above-described image forming apparatus according to the embodiment of the present invention, the tip end parts 13 of the arms 10 are retracted into the main body case 2, so that the arm engagement parts 15, and the case engagement parts 14 and 17 for engagement with the arm engagement parts 15 are provided inside of the main body case 2 and not exposed to outside. With this configuration, the sheet feeding device 1 provides a simple appearance, so that the appearance of the sheet feeding device 1 is enhanced.

As described above, the arm engagement parts 15 slide in contact with the surfaces 2B of the main body case 2 when rotating the sheet feeding tray 3. In this condition, there may be flaws on the surfaces 2B due to the slide of the arm engagement parts 15, but the surfaces 2B are located inside of the main body case 2 and not exposed to outside. Therefore, even if the surfaces 2B suffer flaws, the appearance of the sheet feeding device 1 is not affected.

Figure 7:
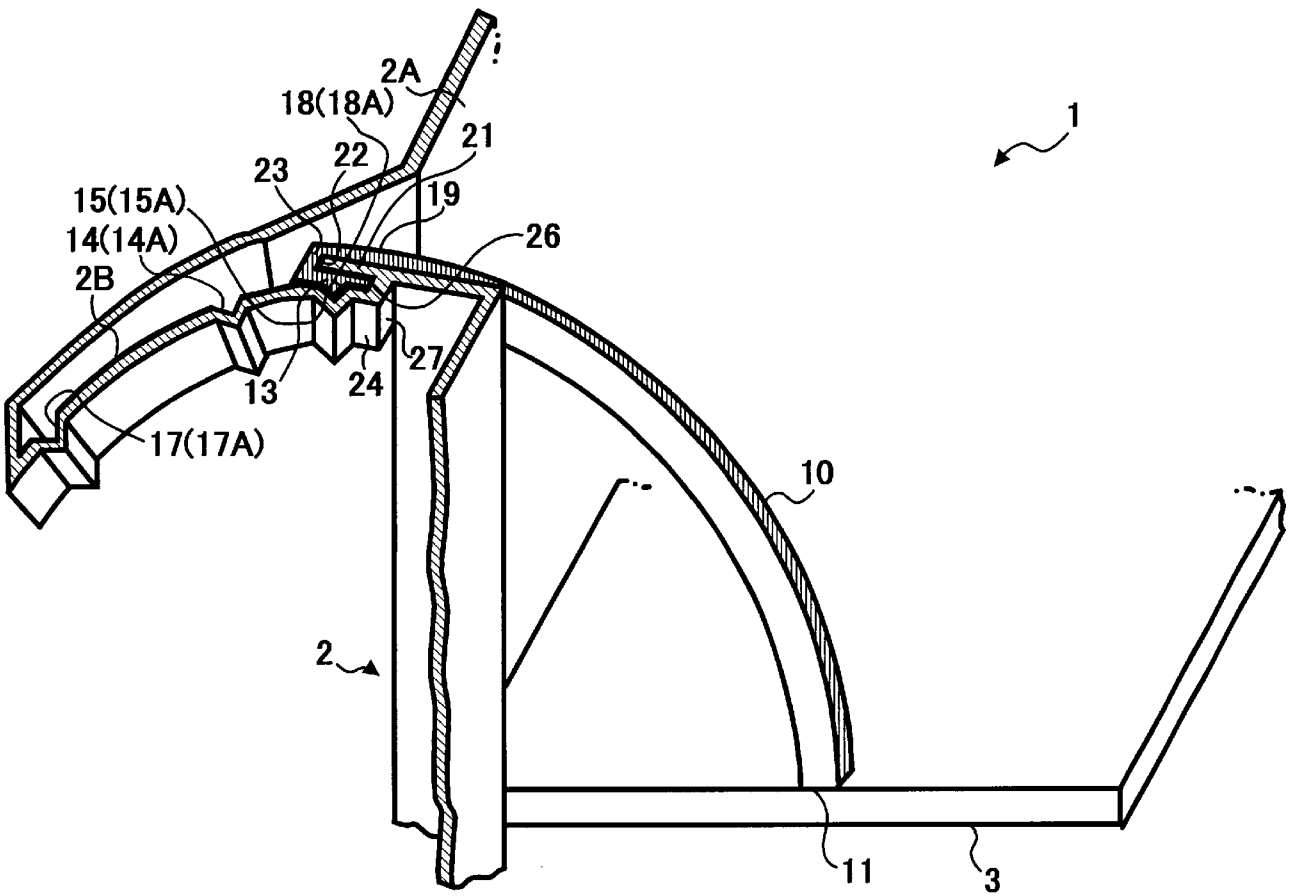
FIG. 7 is a cross sectional perspective view illustrating an assembly state of the arm and the main body case when the sheet feeding tray is located at another open position.

As described earlier, the sheet feeding tray 3 can be configured such that the sheet feeding tray 3 is placed at another open position illustrated by a one-dot-and-dash line in FIG. 3 beside the open position illustrated in FIG. 2. In this case, as illustrated in FIG. 7, in order to place the sheet feeding tray 3 at the another open position, it is preferable to provide case engagement parts 18 for the another open position (hereinafter simply referred to as case engagement parts 18) to the main body case 2 for being engaged with the arm engagement parts 15, respectively. For sake of clarity, FIG. 7 illustrates only one side of the arms 10 and the case engagement parts 18.

In the image forming apparatus illustrated in FIG. 7, the case engagement parts 18 are formed from concave portions 18A, respectively. By engaging the convex portions 15A of the arm engagement parts 15 and the concave portions 18A, the sheet feeding tray 3 is placed at the another open position. If the arm engagement parts 15 are formed from concave portions instead of the convex portions 15A, the case engagement parts 18 are formed from convex portions instead of the concave portions 18A.

As described above, the sheet feeding tray 3 can be placed at the another open position. In this case, for example, sheets can be set on the sheet feeding tray 3 placed at the another open position, or the sheet feeding tray 3 can be used as a table for putting something thereon temporarily.

In the above-described sheet feeding device 1, as illustrated in FIGS. 5 through 7, each tip end part 13 of the arms 10 is formed such that each arm 10 is bent outward at approximately ninety (90°) and is then folded back to the side of the sheet feeding tray 3. Each approximately ninety (90°) bent part of the arms 10 is indicated by reference numeral 23 in FIGS. 5 through 7, and each tip end part 13 of the arms 10 corresponds to a folded-back part. Each arm space 20 is formed such that the arm space 20 is surrounded by the folded-back tip end part 13, an arm part 19 opposing the tip end part 13, and the bent part 23 connecting the arm part 19 and the tip end part 13. As illustrated in FIGS. 5 through 7, when the sheet feeding tray 3 is placed at the open position illustrated by a solid line in FIG. 3 or at the another open position illustrated by a one-dot-and-dash line in FIG. 3, inner side case parts 21 as a part of the main body case 2 are configured to engage in the arm space 20, respectively.

Owing to the engagement between the inner side case parts 21 and the arm space 20, even though a relatively great external force in a further opening direction of the sheet feeding tray 3 is applied to the sheet feeding tray 3 when the sheet feeding tray 3 is placed at the open position or the another open position, tip end surfaces 22 of the inner side case parts 21 abut the bent parts 23, respectively, which thereby prevents the sheet feeding tray 3 from further opening or being detached from the main body case 2.

Further, in the sheet feeding device 1 according to the embodiment of the present invention, as illustrated in FIGS. 5 through 7, each case space 25 is formed such that the case space 25 is surrounded by the inner side case part 21, an outer side case part 24 as a part of the main body case 2 opposing the inner side case part 21, and a bent part 27 bending inward from the outer side case part 24 at approximately ninety (90°) from the outer side case part 24 to the inner side case part 21.

When the sheet feeding tray 3 is placed at the open position illustrated by the solid line in FIG. 3 or at the another open position illustrated by the one-dot-and-dash line in FIG. 3, the tip end parts 13 of the arms 10 are configured to engage in the case space 25, respectively.

Owing to the engagement between the tip end parts 13 and the case space 25, even though a relatively great external force in a further opening direction of the sheet feeding tray 3 is applied to the sheet feeding tray 3 when the sheet feeding tray 3 is placed at the open position or the another open position, tip end surfaces 26 of the tip end parts 13 abut the bent parts 27, respectively, which thereby surely prevents the sheet feeding tray 3 from further opening or being detached from the main body case 2.

As described above, in the sheet feeding device 1, the case engagement parts 14 and 17 of the main body case 2 are formed from the concave portions 14A and 17A, respectively. Further, the arm engagement parts 15 are formed from the convex portions 15A which are engaged with the concave portions 14A and 17A, respectively.

Figure 8:
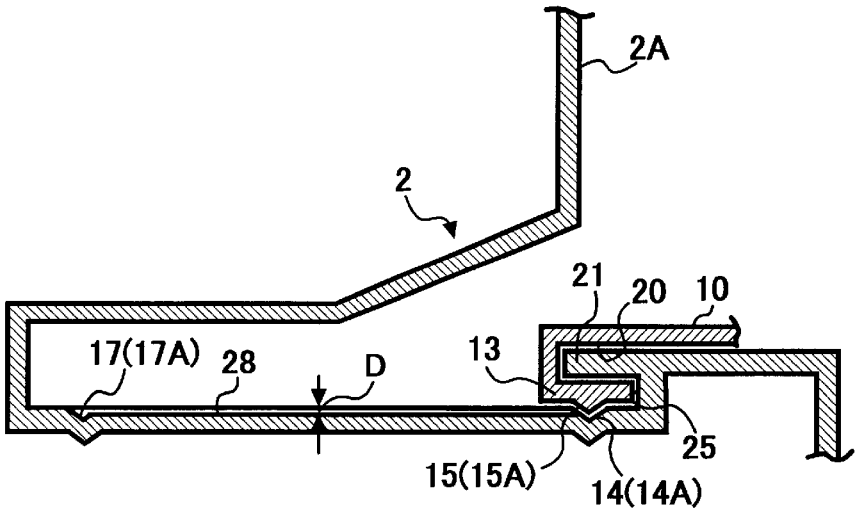
FIG. 8 is a cross sectional view of the main body case and the sheet feeding device when a guide groove is formed in the main body case.
Figure 9A:
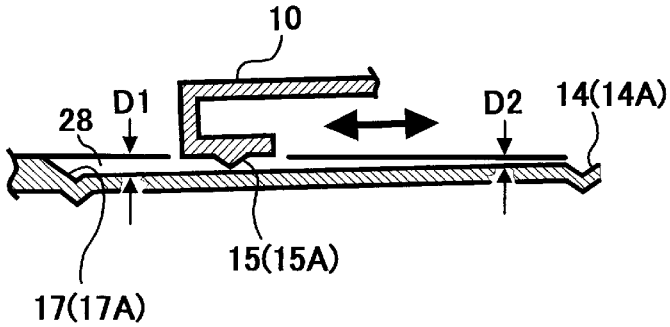
FIG. 9A is a schematic enlarged view of the guide groove of FIG. 8.
Figure 9B:
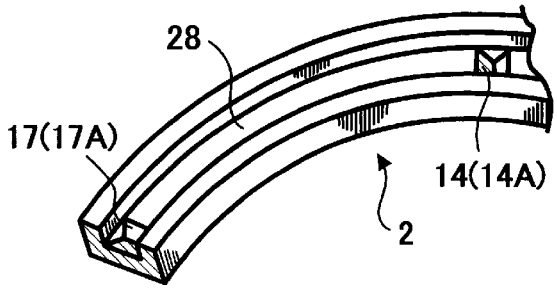
FIG. 9B is a schematic perspective view of the guide groove of FIG. 9A.

Referring to FIGS. 8, 9A and 9B, a pair of guide grooves 28 configured to guide the convex portions 15A of the arm engagement parts 15 can be formed in the main body case 2 with which the convex portions 15A of the arm engagement parts 15 are engaged and slide in contact when rotating the sheet feeding tray 3 between the closed and open positions. For sake of clarity, FIGS. 8, 9A and 9B illustrate only one side of the guide grooves 28. With the guide grooves 28, the arm engagement parts 15 are guided by the guide grooves 28, respectively, when rotating the sheet feeding tray 3 between the closed and open positions, so that the arms 10 can be prevented from floating, and the sheet feeding tray 3 is rotated stably between the closed and open positions.

Figure 10:
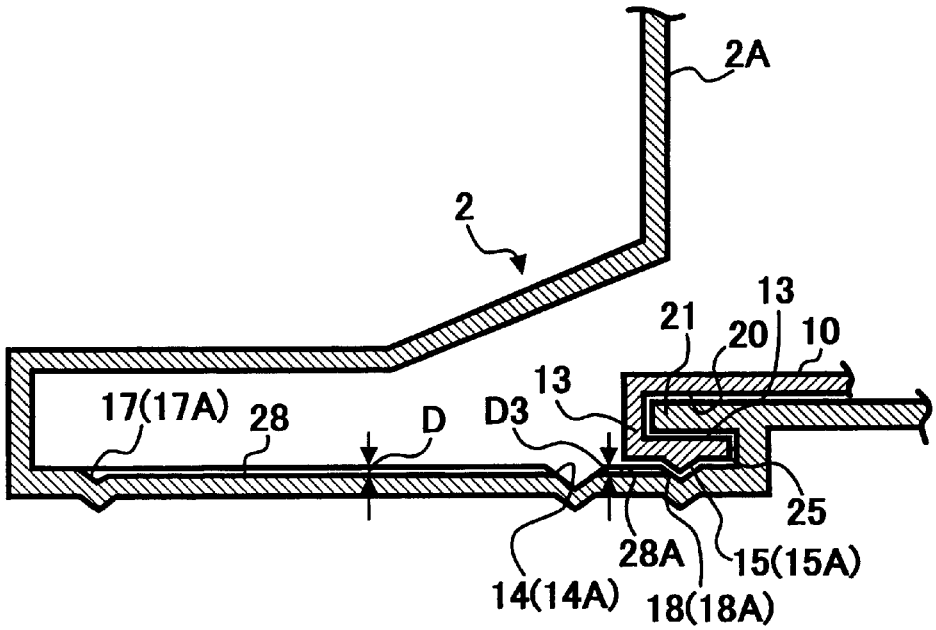
FIG. 10 is a cross sectional view of the main body case and the sheet feeding device when another guide groove is formed in the main body case.
Figure 11:
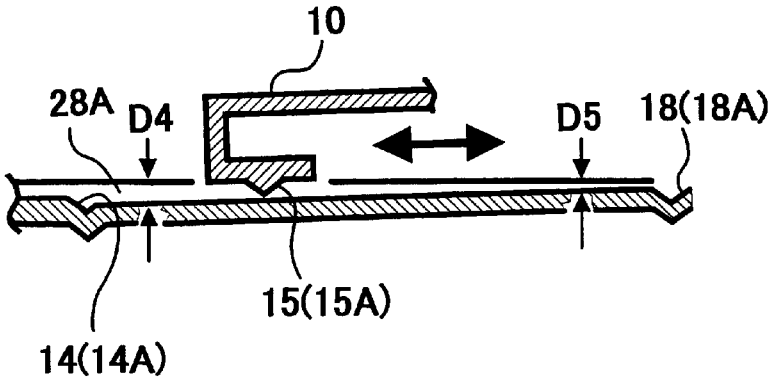
FIG. 11 is a schematic enlarged view of the guide groove of FIG. 10.

In addition to the guide grooves 28, as illustrated in FIGS. 10 and 11, a pair of guide grooves 28A can be formed in the main body case 2 with which the convex portions 15A are engaged and slide in contact when rotating the sheet feeding tray 3 between the open position and the another open position. For sake of clarity, FIGS. 10 and 11 illustrate only one side of the guide grooves 28A. With the guide grooves 28A, the sheet feeding tray 3 is stably rotated between the open position and the another open position.

In the above-described sheet feeding device 1, when the sheet feeding tray 3 is placed at the closed position, the sheet feeding tray 3 stands substantially vertically. As the sheet feeding tray 3 approaches the open position, the sheet feeding tray 3 gradually takes inclined positions. Accordingly, as the sheet feeding tray 3 rotates from the closed position to the open position, the moment due to its own weight exerted on the sheet feeding tray 3 gradually increases. Therefore, even though the above-described guide grooves 28 and 28A are formed in the main body case 2, the rotation speed of the sheet feeding tray 3 may increase before the sheet feeding tray 3 reaches the open position, and relatively large impact may occur on the sheet feeding tray 3 when the sheet feeding tray 3 stops rotating at the open position, which thereby makes an operator uncomfortable.

In order to reduce the above-described impact on the sheet feeding tray 3, it is preferable to construct the arms 10 and the main body case 2 such that a frictional force acted on the arms 10 due to the contact of the main body case 2 and the arms 10 gradually increases when rotating the sheet feeding tray 3 from the closed position to the open position. In this construction, although the moment due to its own weight exerted on the sheet feeding tray 3 gradually increases when rotating the sheet feeding tray 3 from the closed position to the open position, the frictional force acted on the arms 10 also gradually increases. Therefore, the sheet feeding tray 3 does not rapidly increase the rotation speed during the rotation from the closed position to the open position. In this construction, for example, when an operator opens the sheet feeding tray 3 from the closed position to a slightly inclined position with his or her hands, and then removes his or her hands from the sheet feeding tray 3, the sheet feeding tray 3 can be smoothly rotated to the open position at a substantially constant speed.

Further, when the sheet feeding tray 3 is configured to be placed at the another open position, it is preferable to construct the arms 10 and the main body case 2 such that a frictional force acted on the arms 10 due to the contact of the main body case 2 and the arms 10 gradually increases when rotating the sheet feeding tray 3 from the closed position to the another open position.

Specifically, as illustrated in FIGS. 8 and 9A, the guide grooves 28 in the main body case 2 are formed such that a depth "D" of the guide grooves 28 gradually decreases from the case engagement parts 17 to the case engagement parts 14. Referring to FIG. 9A, a depth "D1" is greater than a depth "D2". With this simple construction of the guide grooves 28, the frictional force exerted on the arms 10 can be gradually increased when rotating the sheet feeding tray 3 from the closed position to the open position.

Further, as illustrated in FIGS. 10 and 11, the guide grooves 28A in the main body case 2 are formed such that a depth "D3" of the guide grooves 28A gradually decreases from the case engagement parts 14 to the case engagement parts 18. Referring to FIG. 11, a depth "D4" is greater than a depth "D5". With this construction of the guide grooves 28A, the frictional force exerted on the arms 10 can be gradually increased when rotating the sheet feeding tray 3 from the closed position to the another open position.

Figure 12:
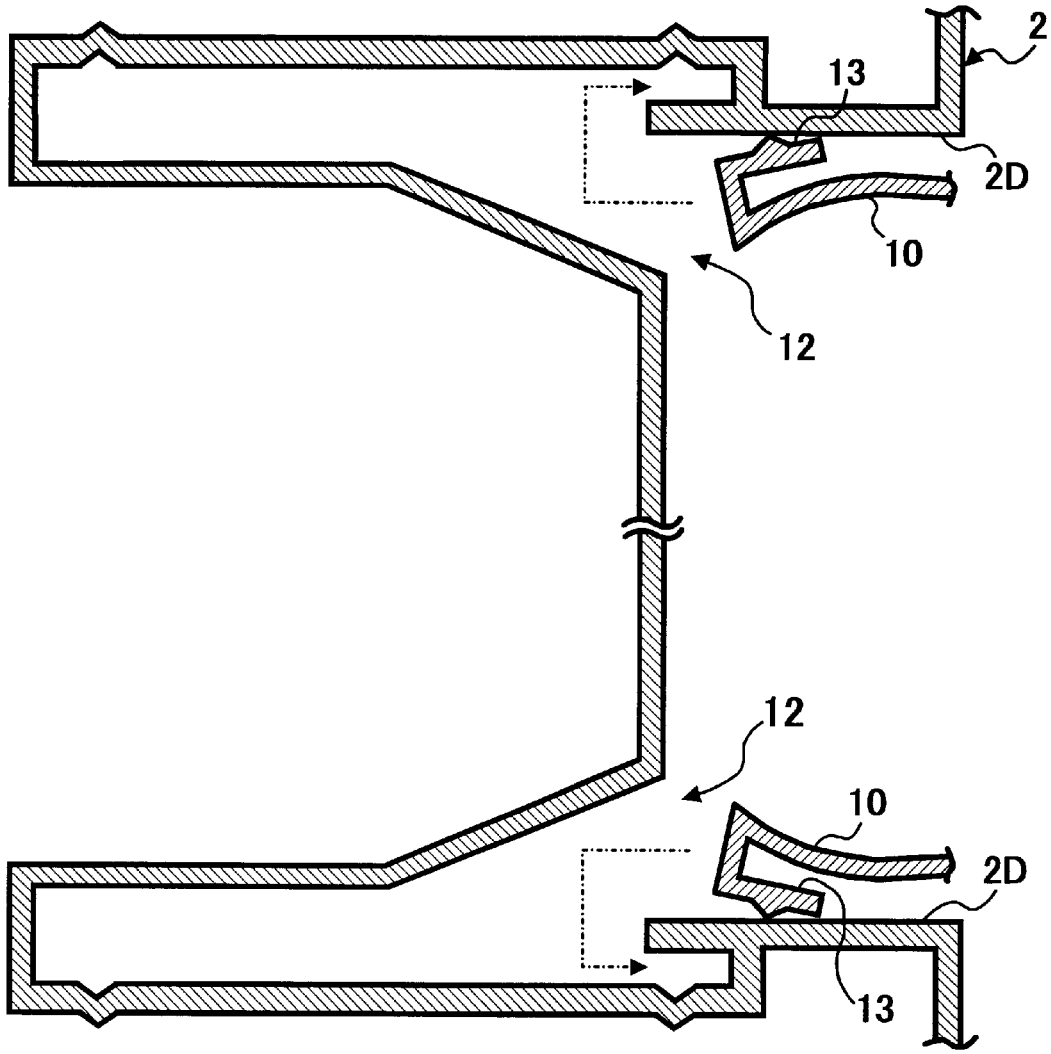
FIG. 12 is a cross sectional view illustrating a state when the arm is assembled to the main body case.

As for assembling the arms 10 to the main body case 2, as illustrated in FIG. 12, the tip end parts 13 of the arms 10 are press-contacted against surfaces 2D of the main body case 2 opposing each other, and then inserted to the openings 12 of the main body case 2, respectively, by deforming the arms 10 elastically. When the tip end parts 13 of the arms 10 become away from the surfaces 2D after being inserted to the openings 12, the tip end parts 13 restore to an original shape illustrated in FIG. 5 and are fit into the main body case 2, respectively. With this simple operation, the arms 10 can be assembled to the main body case 2.

Numerous additional modifications and variations of the present invention are possible in light of the above teachings. It is therefore to be understood that within the scope of the appended claims, the present invention may be practiced otherwise than as specifically described herein.

What is claimed as new and is desired to be secured by Letters Patent of the United States is:

1. A sheet feeding device for an image forming apparatus comprising:

a main body case;

a sheet feeding tray attached to the main body case by a hinge;

a sheet feeding inlet through which a sheet placed on the sheet feeding tray is fed into the main body case;

a sheet feeding member configured to feed a sheet on the sheet feeding tray into the main body case; and an arm including a base end part and a tip end part, wherein:

the sheet feeding tray is in a closed position when the sheet feeding inlet is closed and the sheet feeding tray is in a first open position when the sheet feeding inlet is open, the base end part is attached to the sheet feeding tray at a predetermined distance from the hinge, the tip end part is housed in the main body case, and the main body case includes a first open position engagement part formed integrally as one piece with the main body case, and the tip end part includes an arm engagement part configured to engage with the first open position engagement part when the sheet feeding tray is in the first open position.

2. The sheet feeding device according to claim 1, wherein:

the main body case further includes a closed position engagement part; and the arm engagement part is configured to engage with the closed position engagement part when the sheet feeding tray is closed.

3. The sheet feeding device according to claim 2, wherein:

the main body case further includes a second open position engagement part; and the arm engagement part is configured to engage with the second open position engagement part when the sheet feeding tray is in a second open position.

4. The sheet feeding device according to claim 1, wherein:

the main body case further includes a second open position engagement part; and the arm engagement part is configured to engage with the second open position engagement part when the sheet feeding tray is in a second open position.

5. The sheet feeding device according to claim 1, wherein:

the tip end part is formed from a part of the arm folded back toward the sheet feeding tray;

an arm space is formed between the tip end part and a part of the arm opposing the tip end part of the arm; and the sheet feeding tray is configured to engage inner side case parts of the main body case in the arm space.

6. The sheet feeding device according to claim 5, wherein:

the main body case includes a first open position engagement space; and the tip end part of the arm is configured to be engaged in the first open position engagement space when the sheet feeding tray is in the first open position.

7. The sheet feeding device according to claim 2, wherein:

the first open position engagement part and the closed position engagement part are formed from concave portions and the arm engagement part is formed from a convex portion configured to engage with each concave portion; and when the main body case includes a guide groove configured to guide the convex portion the sheet feeding tray is rotated between the closed position and the first open position.

8. The sheet feeding device according to claim 4, wherein:

the first open position engagement part, the second open position engagement part, and the closed position engagement part are formed from concave portions;

the arm engagement part is formed from a convex portion configured to engage with each of the concave portions; and a guide groove is configured to guide the convex portion when the sheet feeding tray is rotated between the closed position and the second open position.

9. The sheet feeding device according to claim 2, wherein the arm and the main body case are constructed so that a frictional force acted on the arm, due to contact with the main body case, increases as the sheet feeding tray is rotated from the closed position to the first open position.

10. The sheet feeding device according to claim 3, wherein the arm and the main body case are constructed so that a frictional force acted on the arm, due to contact with the main body case, increases as the sheet feeding tray is rotated from the closed position to the second open position.

11. The sheet feeding device according to claim 7, wherein the guide groove is formed in the main body case so that a depth of the guide groove decreases from the closed position engagement part to the first open position engagement part.

12. The sheet feeding device according to claim 8, wherein the guide groove is formed in the main body case so that the depth of the guide groove decreases from the closed position engagement part to the second open position engagement part.

13. A method of operating a sheet feeding device for an image forming apparatus including a main body case, the method comprising:

rotating a sheet feeding tray to an open position responsive to a sheet feeding inlet being opened;

engaging an arm engagement part with an open position engagement part;

feeding a sheet on the sheet feeding tray into the main body case through the sheet feeding inlet;

rotating the sheet feeding tray to a closed position engagement part responsive to the sheet feeding inlet being closed; and engaging the arm engagement part with a closed position engagement part, wherein the main body case includes the closed position engagement part, wherein the sheet feeding inlet is configured to feed a sheet into the main body case, and wherein an arm fixed to the sheet feeding tray includes the arm engagement part and the main body case includes the open position engagement part formed integrally as one piece with the main body case.

14. The method according to claim 13, wherein engaging the arm engagement part with the open position engagement part includes engaging an arm space with inner side case parts of the main body case, wherein the arm includes a tip end part, and wherein the arm space is formed between the tip end part and a part of the arm opposing the tip end part of the arm.

15. The method according to claim 14, wherein engaging the arm engagement part with the open position engagement part further includes engaging the tip end part of the arm in an open position engagement space formed between a first part of the main body case and a second part of the main body case, and wherein the second part of the main body case opposes the first part of the main body case.

16. The method according to claim 13, wherein rotating the sheet feeding tray to the open position and rotating the sheet feeding tray to the closed position each include engaging and sliding a convex portion of the arm engagement part in a guide groove formed in the main body case.

17. The method according to claim 13, wherein rotating the sheet feeding tray to the open position further includes gradually increasing a frictional force acting on the arm due to contact of the main body case and the arm.

18. A sheet feeding device for an image forming apparatus, comprising:

a main body case comprising a sheet feeding inlet;

a sheet feeding tray coupled to the main body case by a hinge;

an arm attached to the sheet feeding tray;

a means for rotating the sheet feeding tray to an open position when the sheet feeding inlet is open;

a means for rotating the sheet feeding tray to a closed position when the sheet feeding inlet is closed;

a means for feeding a sheet from the sheet feeding tray into the main body case through the sheet feeding inlet;

a means for engaging the arm with the main body case when the sheet feeding tray is in the open position; and a means for engaging the arm with the main body case when the sheet feeding tray is in the closed position.

19. The sheet feeding device of claim 18, wherein the means for engaging the arm with the main body case when the sheet feeding tray is in the open position comprises the arm comprising a mechanical arm engagement part and the main body case comprising a mechanical open position engagement part.

20. The sheet feeding device of claim 18, wherein the means for engaging the arm with the main body case when the sheet feeding tray is in the closed position comprises the arm comprising a mechanical arm engagement part and the main body case comprising a mechanical closed position engagement part.

* * * * *